US007390110B2

(12) United States Patent
Katz et al.

(10) Patent No.: US 7,390,110 B2
(45) Date of Patent: Jun. 24, 2008

(54) ARTICLE SUPPORT DEVICE

(75) Inventors: Robert Katz, Montreal (CA); Sylvain Duchesne, Bromont (CA); Daniel Costello, Waterloo (CA)

(73) Assignee: Canlyte, Inc., Lachine, Quebec (CA)

( * ) Notice: Subject to any disclaimer, the term of this patent is extended or adjusted under 35 U.S.C. 154(b) by 0 days.

(21) Appl. No.: 11/423,032

(22) Filed: Jun. 8, 2006

(65) Prior Publication Data

US 2007/0014115 A1 Jan. 18, 2007

Related U.S. Application Data

(60) Provisional application No. 60/688,840, filed on Jun. 9, 2005, provisional application No. 60/688,857, filed on Jun. 9, 2005, provisional application No. 60/688, 803, filed on Jun. 9, 2005.

(51) Int. Cl.
*F21V 19/00* (2006.01)

(52) U.S. Cl. ..... 362/382; 362/427; 362/418; 362/419

(58) Field of Classification Search ..... 362/170, 362/177, 418, 414, 419, 422, 197, 287, 199, 362/275, 269, 281, 283, 282, 285, 382, 427
See application file for complete search history.

(56) References Cited

U.S. PATENT DOCUMENTS

| | | | | |
|---|---|---|---|---|
| 2,361,853 | A | 10/1944 | Lundquist | |
| 3,205,522 | A | 9/1965 | Then | |
| 3,533,648 | A | 10/1970 | Thieberger | |
| 3,778,610 | A | 12/1973 | Wolf | |
| 4,979,139 | A | 12/1990 | Chin-Song | |
| 5,132,492 | A | 7/1992 | Wieder | |
| 5,564,852 | A | 10/1996 | Maxwell et al. | |
| 5,584,574 | A * | 12/1996 | Haddad | 362/359 |
| 5,599,091 | A * | 2/1997 | Kira | 362/269 |
| 5,605,394 | A | 2/1997 | Chen | |
| 5,651,606 | A * | 7/1997 | Krogman | 362/96 |
| 5,713,662 | A * | 2/1998 | Kira | 362/427 |
| 5,988,833 | A * | 11/1999 | Giese et al. | 362/287 |
| 6,079,682 | A | 6/2000 | Olkkola | |
| 6,161,948 | A | 12/2000 | Hagen | |

(Continued)

FOREIGN PATENT DOCUMENTS

| | | |
|---|---|---|
| CA | 2415537 | 9/2003 |

*Primary Examiner*—Ali Alavi
*Assistant Examiner*—Evan Dzierzynski
(74) *Attorney, Agent, or Firm*—John F. Salazar; Middleton Reutlinger

(57) ABSTRACT

A light fixture device has a light housing to receive a light source therein, a support assembly for supporting the light fixture relative to an anchor location, the support assembly including a post portion for mounting at the anchor location and a body portion, the body portion having a pair of opposed end regions, the post portion including a pair of cavities, each to receive a corresponding end region, the body portion being movable relative to the post portion about a first axis, the body portion and light housing having respective first and second support formations, the light housing being movable relative to the body portion about a second axis, to cause corresponding relative movement between the first and second support formations, the end regions and cavities having complementary third and fourth support formations, wherein relative movement between the body portion and post portion causes a corresponding relative movement between the complementary third and fourth formations.

21 Claims, 17 Drawing Sheets

U.S. PATENT DOCUMENTS 6,409,411 B1 6/2002 Crorey
6,527,466 B1 3/2003 Blier et al.
6,966,679 B2 * 11/2005 Matts et al. ..... 362/418
2003/0007355 A1 * 1/2003 Leen ..... 362/287
2003/0016524 A1 * 1/2003 Smith ..... 362/35
2006/0104053 A1 * 5/2006 Etter et al. ..... 362/109

* cited by examiner

ARTICLE SUPPORT DEVICE

CROSS-REFERENCE TO RELATED APPLICATIONS

The entire matter of each of the following applications is incorporated herein by reference:

U.S. Provisional application Ser. No. 60/688,840 filed Jun. 9, 2005 and entitled ARTICLE SUPPORT DEVICE;

U.S Provisional application Ser. No. 60/688,857 filed Jun. 9, 2005 and entitled MOUNTING ASSEMBLY FOR MOUNTING COMPONENTS IN A LIGHT FIXTURE; and U.S. application Ser. No. 60/688,803 filed Jun. 9, 2005 and entitled MOUNTING ARRANGEMENT FOR A LIGHT FIXTURE.

The application claim priority benefit under Title 35, U.S. Code, Section 119 of each of the above mentioned applications.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to support assemblies for articles such as, by way of example only, light fixtures.

2. Description of the Related Art

Exit lights are ubiquitous in commercial spaces, typically placed above exit doors or in strategic areas in hallways directing occupants to the closest exit. The exit lights are well known with a housing surrounding a light source which illuminates a stencilled "EXIT" or "SORTIE" or "EXIT SORTIE" image. In most cases, the exit light, or a battery backup unit adjacent thereto, provides back up lighting in the event of a power failure, by way of one or more relatively small light fixtures supported on the housing. The light fixtures have an adjustable support which allows the installer to position the light fixture at a target location for maximum benefit. It is an aim of the present invention to provide a novel device and method for supporting an article.

SUMMARY OF THE INVENTION

In one of its aspects, the present invention provides a light fixture device comprising a light housing to receive a light source therein, a support assembly for supporting the light fixture relative to an anchor location, the support assembly including a post portion for mounting at the anchor location and a body portion, the body portion having a pair of opposed end regions, the post portion including a pair of cavities, each to receive a corresponding end region, the body portion being movable relative to the post portion about a first axis, the body portion and light housing having respective first and second support formations, the light housing being movable relative to the body portion about a second axis, to cause corresponding relative movement between the first and second support formations, the end regions and cavities having complementary third and fourth support formations, wherein relative movement between the body portion and post portion causes a corresponding relative movement between the complementary third and fourth formations.

In an embodiment, the first and second support formations are operable for releasably locking the position of the light housing relative to the support assembly.

In an embodiment, the first and second support formations include complementary locking elements.

In an embodiment, the locking elements include projections.

In an embodiment, the projections include one or more teeth.

In an embodiment, each of the first and second support formations includes at least one support surface with the teeth distributed along the support surface.

In an embodiment, the body portion includes a platform and a disc member positioned on the platform.

In an embodiment, the light housing further comprises a recessed surface which is complementary with the disc member.

An embodiment further comprises a fastener portion for fastening the light housing to the body portion.

An embodiment further comprises a first fastener passage centrally disposed in the recessed surface to receive the fastener portion.

In an embodiment, the disc member includes a second fastener passage; the fastener portion being integrally formed with the platform to extend through the second fastener passage.

In an embodiment, wherein the fastener portion includes a pair of resilient notched webs, each to engage a peripheral portion of the light housing adjacent the first fastener passage.

In an embodiment, the platform and disc member have complementary engaging formations thereon to inhibit relative movement therebetween.

In an embodiment, the complementary formations include a plurality of projections on the platform which engage corresponding recesses in the disc member.

In an embodiment, each of the opposed end regions includes a first outer surface, the post portion including a second inner surface exposed in each cavity, each second inner surface to engage a corresponding first outer surface.

In an embodiment, the post portion includes a pair of opposed wall sections, each containing a corresponding cavity.

In an embodiment, the first outer and second inner surfaces are formed on corresponding cylindrical surfaces whose central axes are parallel to the first axis.

In an embodiment, each wall section includes at least one arm bordering the cavity, the arm being resiliently mounted for relative movement with the wall section.

In an embodiment, each side wall section includes a pair of opposed arms bordering the cavity, at least a portion of the second inner surfaces being formed on the pair of opposed arms.

In an embodiment, each side wall section includes an end panel adjacent each arm.

In an embodiment, each side wall section includes a lateral portion adjacent the arms.

In an embodiment, the lateral portion is spaced from the end panel to form a gap therebetween.

In an embodiment, the body portion and fastener portion include passages in communication with the gap to receive wiring for delivering power to the light housing.

In an embodiment, the first outer surfaces and the second inner surfaces include complementary locking elements.

In an embodiment, the locking elements include projections.

In an embodiment, the projections include one or more teeth.

In another of its aspects, the present invention provides a mounting device for mounting a light fixture, the mounting device comprising a post portion, mounting means for mounting the post portion to an anchor location, a body portion movable relative to the post portion about a first axis, the post portion at least partially enclosing the body portion, the body portion extending outwardly from the post portion and including a first support formation, a fastening means for mounting the light housing to the first support formation for relative movement therewith about a second axis.

In yet another of its aspects, the present invention provides a light fixture assembly comprising a light housing and the mounting device as defined herein above, the light housing having a second support formation, the light housing being movable relative to the body portion about a second axis, to cause corresponding relative movement between the first and second support formations.

In an embodiment, the first and second support formations include complementary indexing formations thereon.

In yet another of its aspects, a light fixture assembly comprising a core portion rotatable about a first central axis and having opposed cylindrical end regions, each cylindrical end region including a toothed outer surface, a pair of mount housing portions, each of which includes a cylindrical toothed inner surface engageable with a corresponding toothed outer surface, a support portion extending from the core portion, the support portion including a toothed seat, a light housing having a toothed housing surface portion to mate the toothed seat, and a fastener portion for fastening the light housing to the support portion, for relative moment therebetween about a second axis.

In an embodiment, the support portion extends at ninety degrees relative to the first axis, though other angular orientations are also contemplated In an embodiment, the housing portions each includes a spring arm, at least a portion of the toothed surface being formed thereon.

In another of its aspects, the present invention provides a support assembly for supporting an article, comprising an anchor portion having a pair of opposed cylindrical shell elements, an elongate body portion having a first axis and a pair of opposed cylindrical end regions cylindrically disposed in line with the first axis, each cylindrical end region arranged to fit within a corresponding shell element, a mounting portion joined to the elongate body portion and arranged to extend beyond the cylindrical shell elements for mounting an article thereon, each cylindrical end region on the elongate body portion having an outer cylindrical surface, each cylindrical shell element having an inner cylindrical surface which is arranged for engaging a corresponding outer cylindrical surface in a manner sufficient for releasably holding the elongate body portion in an operative position.

In an embodiment, the outer and inner cylindrical surfaces include complementary releasable locking formations for indexing relative movement therebetween.

In an embodiment, the releasable locking formations include one or more gear teeth.

In an embodiment, each cylindrical shell element includes at least one spring arm adjacent a corresponding inner cylindrical surface, the at least one spring arm having one or more than one gear tooth.

In an embodiment, each cylindrical shell element includes a pair of opposed spring arms adjacent a corresponding inner cylindrical surface, the spring arms having one or more than one gear teeth thereon.

In an embodiment, the mounting portion includes a first planar mounting surface and a fastener extending from the mounting surface to fasten the article thereto.

In an embodiment, the mounting surface includes locking formations thereon for indexing relative movement between the article and the mounting portion.

In an embodiment, the locking formations on the first mounting surface include one or more gear teeth.

In an embodiment, the article includes a second mounting surface formed thereon.

In an embodiment, the article includes a recessed portion, the second mounting surface being formed in the recessed portion.

In an embodiment, the mounting portion is arranged to extend into the recessed portion. In an embodiment, the mounting portion includes a platform and a disc positioned on the platform.

In an embodiment, the disc is fixed in position relative to the platform. In an embodiment, the disc has a first passage, the fastener extending through the passage.

In an embodiment, the recessed portion includes a second passage to receive the fastener. In still another of its aspects, the present invention provides a light fixture device, comprising an articulating anchor portion and a light source support, the anchor having a planar disc, a light source support having a circular recessed surface portion to receive the disc, the disc and recessed surface portions having complementary formations thereon for indexing relative movement between the light source support and the anchor.

In still another of its aspects, the present invention provides a light fixture device, comprising an anchor portion and a light source support attached thereto, the anchor portion having a pair of opposed cylindrical shell elements, an elongate body portion having a first axis and a pair of opposed cylindrical end regions cylindrically disposed in line with the first axis, each cylindrical end region arranged to fit within a corresponding shell element, a mounting portion joined to the elongate body portion and arranged to extend beyond the cylindrical shell elements, the mounting portion engaged with the light source support, each cylindrical end region on the elongate body portion having an outer cylindrical surface, each cylindrical shell element having an inner cylindrical surface which is arranged for engaging a corresponding outer cylindrical surface in a manner sufficient for releasably holding the elongate body portion in an operative position, to hold the light source support in an operative orientation relative to the anchor portion.

In still another of its aspects, the present invention provides An article support device, comprising an anchor portion and an article support portion attached thereto, the anchor portion having a pair of opposed cylindrical shell elements, an elongate body portion having a first axis and a pair of opposed cylindrical end regions disposed in line with the first axis, each cylindrical end region arranged to fit within a corresponding shell element, a mounting portion joined to the elongate body portion and arranged to extend beyond the cylindrical shell elements, the mounting portion engaged with the article support portion, each cylindrical end region on the elongate body portion having a first cylindrical surface, each cylindrical shell element having a second cylindrical surface which is arranged for engaging a corresponding first cylindrical surface in a manner sufficient for releasably holding the elongate body portion in an operative position, to hold the article support portion in an operative orientation relative to the anchor portion.

Preferably, the article is a light fixture housing or a light fixture, but be or include other articles as well that are suitable to be positioned as described herein.

In still another of its aspects, the present invention provides a method of supporting an article, comprising the steps of:

providing an anchor portion with a pair of opposed cylindrical shell elements;

providing an elongate body portion with a first axis and a pair of opposed cylindrical end regions cylindrically disposed in line with the first axis, providing each cylindrical end region on the elongate body portion with an outer cylindrical surface and providing each cylindrical shell element with an inner cylindrical surface, fitting each cylindrical end region within a corresponding shell element by engaging each outer cylindrical surface with a corresponding inner cylindrical surface, joining a mounting portion to the elongate body portion to extend beyond the cylindrical shell elements for mounting an article thereon, and providing a sufficiently firm engagement between the cylindrical end regions and the corresponding cylindrical shell elements for releasably holding the elongate body portion in an operative position.

BRIEF DESCRIPTION OF THE DRAWINGS

Several preferred embodiments of the present invention will now be described, by way of example only, with reference to the appended drawings in which.

DESCRIPTION OF THE PREFERRED EMBODIMENTS

Figure 1:
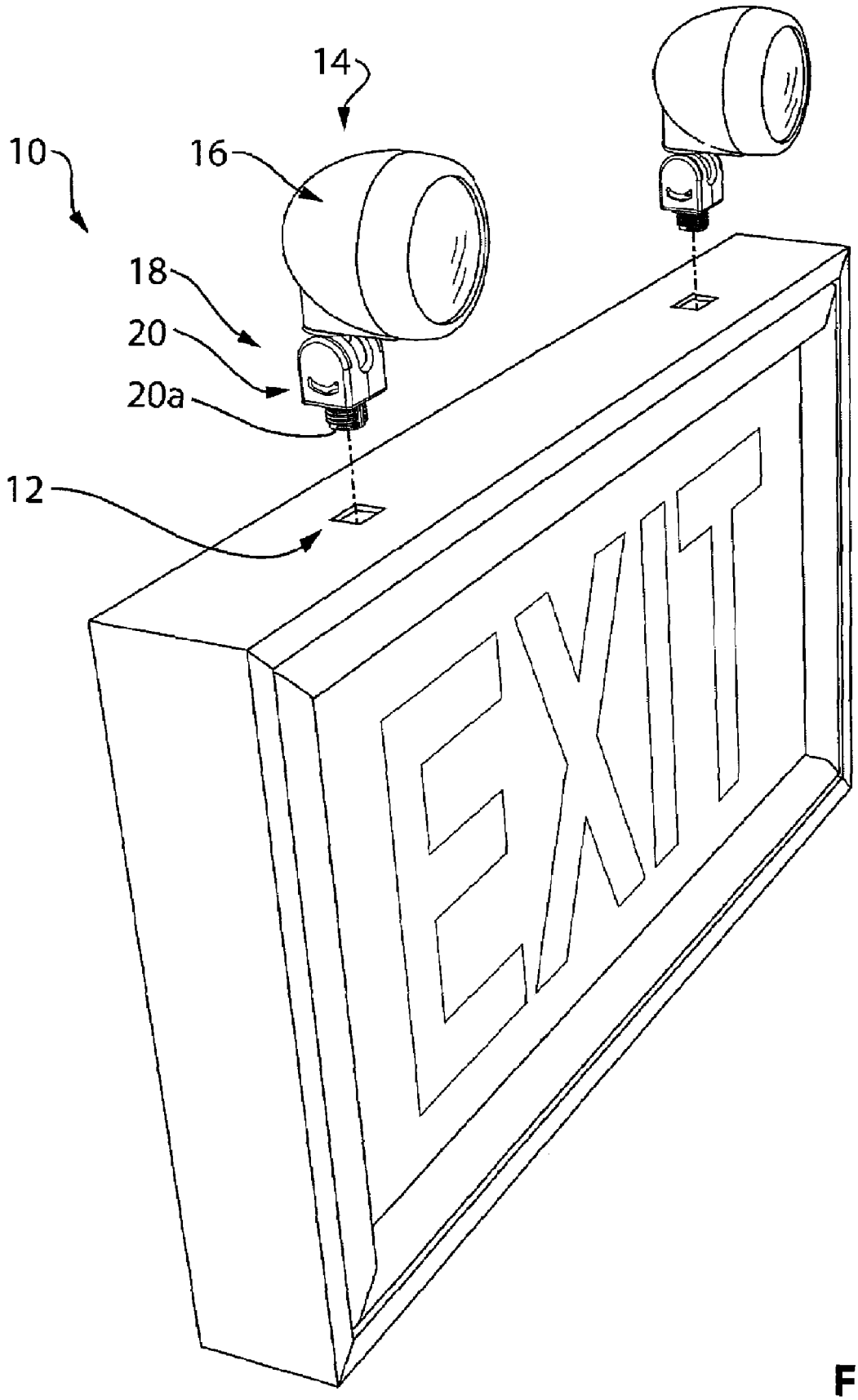
FIG. 1 is a perspective assembly view of an exit sign assembly.

FIG. 1 shows an exit sign assembly 10 with a pair of anchor locations 12. Each anchor location is rectangular in shaped and arranged to receive a light fixture 14, as will be explained. The light fixture 14 has a light housing 16 to receive a light source therein (not shown). A support assembly 18 supports the light fixture 14 relative to the anchor location 12. The support assembly 18 includes a post portion generally shown at 20 whose lowermost end 20*a* is threaded to permit the post portion to be mounted at the anchor location 12 and shaped to match the shape of the anchor location.

Figure 2:
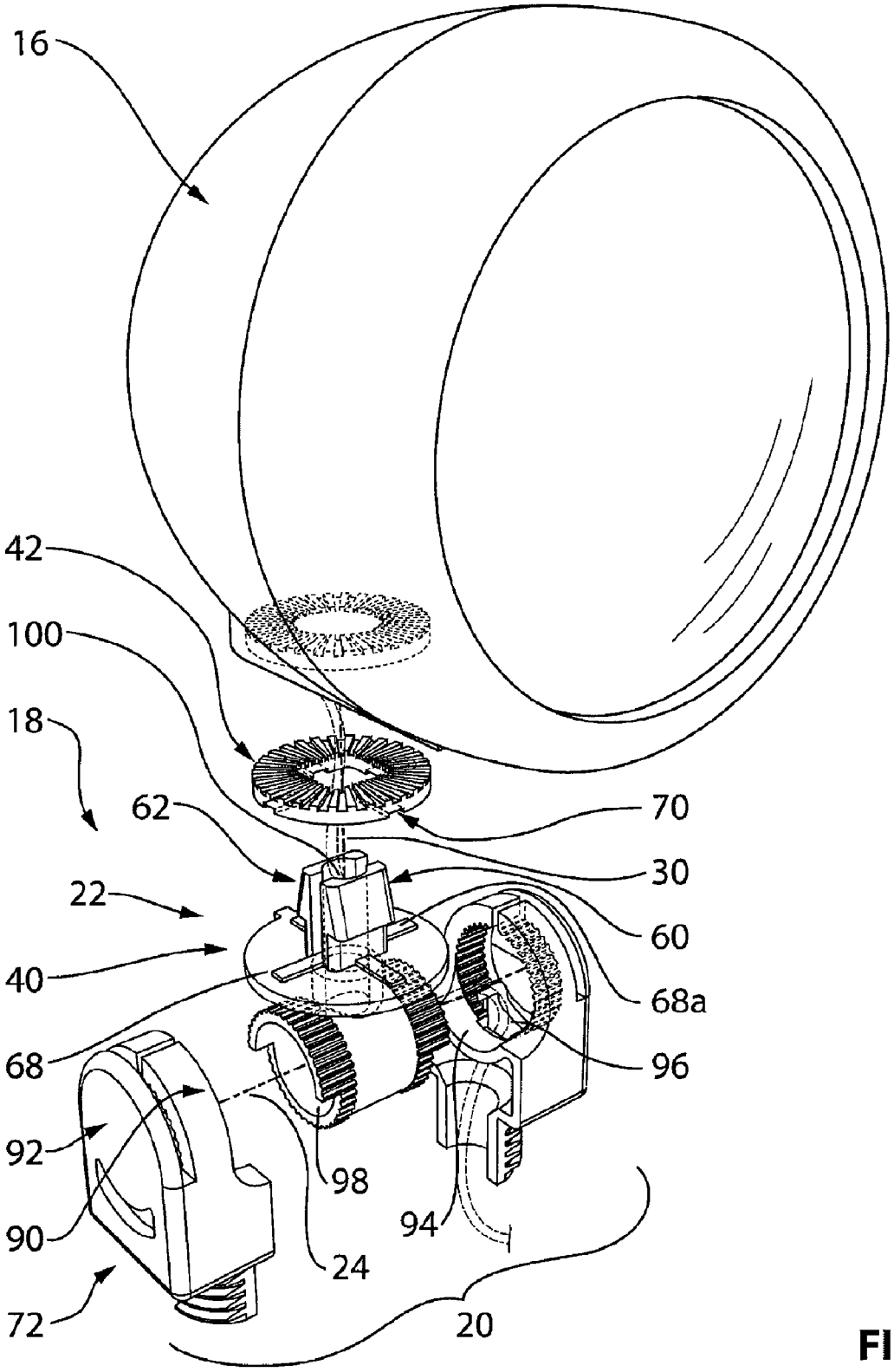
FIG. 2 is an assembly view of a light fixture portion of the assembly of FIG. 1.
Figure 3:
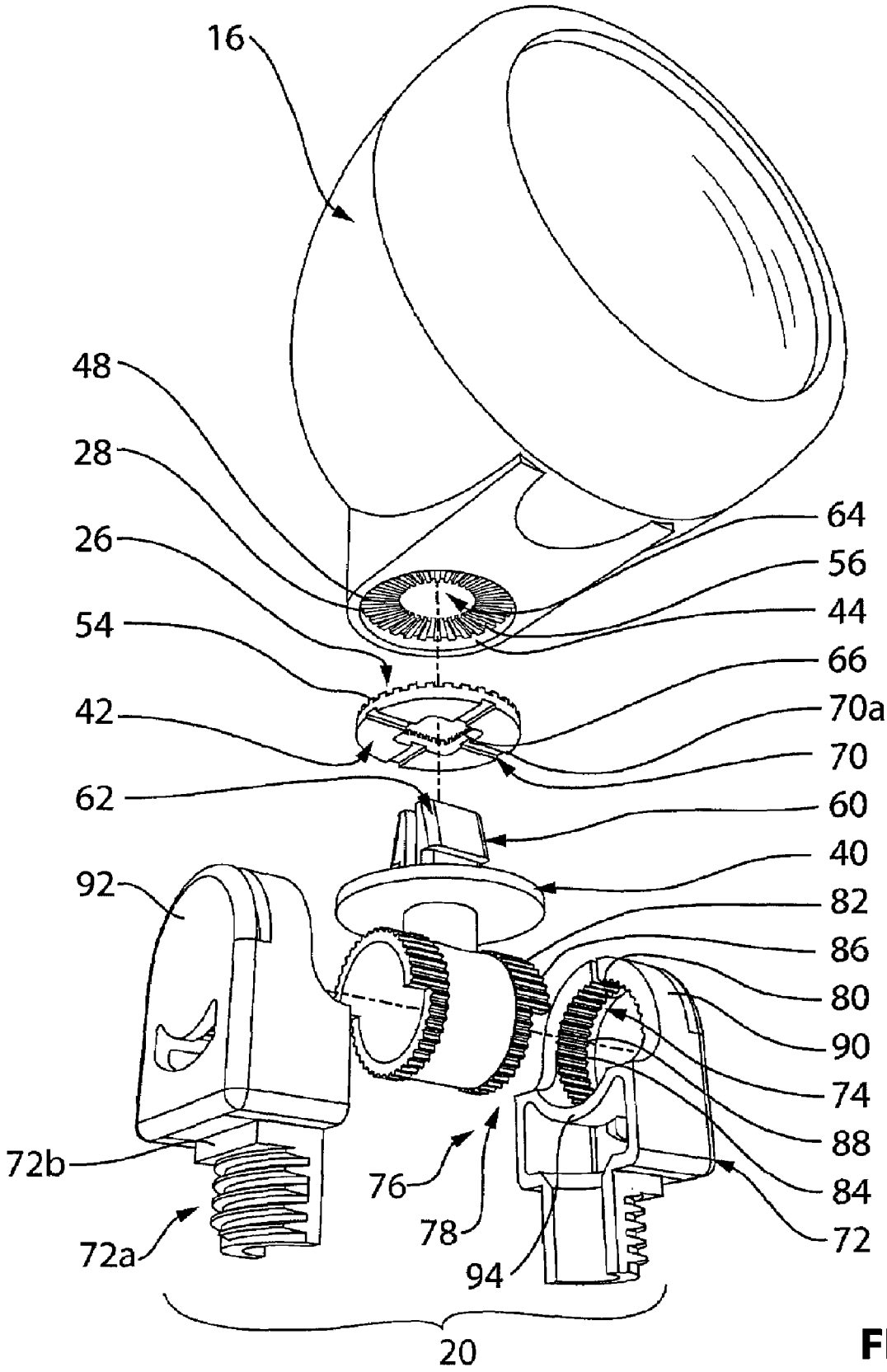
FIG. 3 is another assembly view of a light fixture portion of FIG. 2.

Referring to FIGS. 2 and 3, the support assembly 18 includes a body portion 22 which is movable relative to the post portion 20 about a first axis 24. The body portion 22 and light housing 16 are provided with first and second support formations shown generally at 26, 28 (FIG. 3) and the light housing 16 is movable relative to the body portion 22 about a second axis 30, to cause corresponding relative movement between the first and second support formations 26, 28.

The body portion includes a platform 40 and a disc member 42 positioned on the platform 40. The light housing 16 is provided with a recessed surface 44 which is complementary with the disc member 42. The recessed surface is beneficial because it engages and surrounds the disc member 42. However, the recessed nature of the surface 44 may not be needed in some cases and may instead be provided with a periphery which is continuous with the housing.

As will be described, the first and second support formations 26, 28 are operable for releasably locking the position of the light housing 16 relative to the support assembly 18. In this particular example, the first and second support formations 26, 28 include complementary locking elements, which preferably include projections, such as one or more teeth 54 distributed along the disc member 42 and which are complementary with teeth 56 distributed around recessed surface 44.

A fastener portion 60 is integrally formed with and extends upwardly from the platform 40 for fastening the light housing 16 to the body portion 22. In this case, the fastener portion 60 is provided by a pair of resilient notched webs 62, which are integrally formed with the platform 40. The light housing 16 has a first fastener passage 64 centrally disposed in the recessed surface 44 to receive the notched webs 62. Each of the resilient notched webs 62, when clipped into the light housing 16, engages a peripheral portion of the light housing adjacent the first fastener passage 64.

The notched webs 62 also extend through a second fastener passage 66 in the disc member 42. In this case, it will be seen that the second fastener passage 66 and the notched webs 62 have rectangular cross sections which ensure that the disc member 42 does not rotate relative to the notched webs 62. On the other hand, the first fastener passage 64 is circular in cross section to permit the notched webs 62 to rotate about the light housing 16.

The platform 40 and disc member 42 have mutually complementary engaging formations 68, 70 thereon to inhibit relative movement therebetween. As best seen in FIG. 2, the formations 68 are provided in the form of projections 68*a* on the platform 40 which engage corresponding recesses 70*a* in the disc member 42 (FIG. 3).

The post portion 20 is formed by a pair of symmetrical opposed wall sections 72, each of which has a cavity 74. The symmetrical nature of the end sections is convenient, because it provides for simpler manufacture while maintaining a pleasing appearance. That being said, there may be instances where having end sections which are unsymmetrical is useful or preferred over symmetrical end sections and may be suitable in some cases. Each wall section 72 also has a lower section 72*a*, which together form the lower most end 20*a*. In this case, the lower section 72*a* includes a rectangular boss 72*b*, thus providing the lower most end with a rectangular outer surface region to engage the corresponding rectangular anchor formation 12 to inhibit rotation of the light fixture when being fastened in place. Other shaped bosses may be employed as desired, it being understood that the device may also be suitable without a boss in some cases. The body portion 22 includes a pair of opposed cylindrically shaped end regions 76, each of which extends into a corresponding cavity 74. Each of the opposed end regions 76 includes a first outer surface 78 and each wall section includes a second inner surface 80 bordering each cavity 74. These inner and outer surfaces 78, 80 form an interface to control relative movement of the body and post portions, as will now be described.

The post and body portions are provided with complementary third and fourth support formations 82, 84, which control relative movement between the post and body formations 20, 22. In this case, any relative movement between the post and body formations 20, 22 causes a corresponding relative movement between the complementary third and fourth formations 82, 84. The third formations 82 can be seen as teeth 86 extending circumferentially around each first outer surface 78. Meanwhile, the fourth formations 84 are provided in the form of complementary teeth 88 extending circumferentially around each second inner surface 80. However, other examples of formations 82, 84 are contemplated including those described hereinbelow.

Figure 3A:
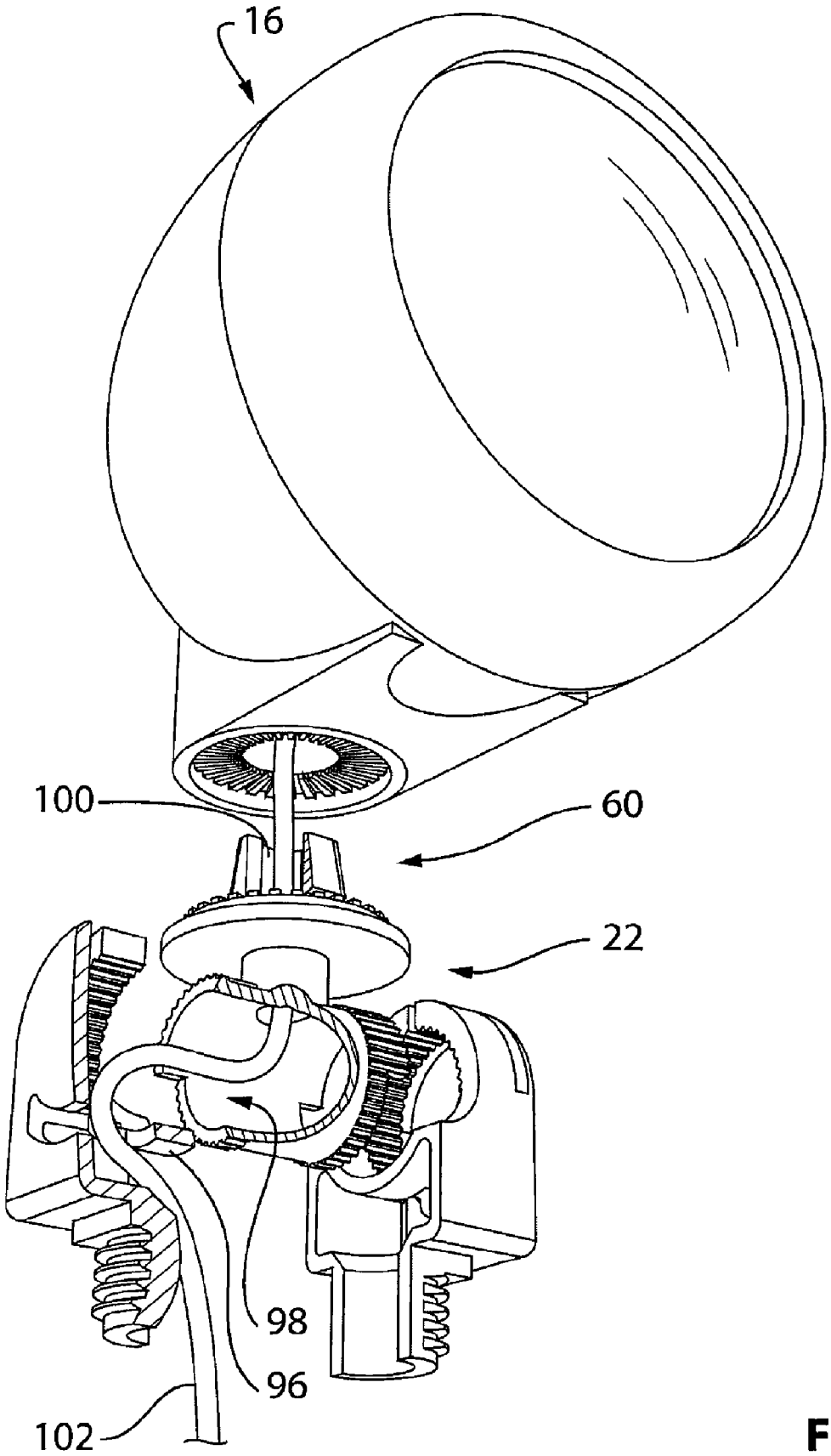
FIG. 3*a* is a partly fragmented assembly view of a light fixture portion of FIG. 2.

Each wall section 72 includes at least one, in this case a pair, of opposed arms 90 bordering the cavity 74. The wall section 72 has an end panel 92 adjacent each arm 90 and a lateral portion 94 which, together with the arms, extends circumferentially around the cavity 74. The arms 90 are spaced from the end panel 92 to provide unrestricted movement of the arms 90, while the lateral portion 94 is spaced from the end panel 92 to form a gap shown at 96, as best shown in FIGS. 2 and 3*a*.

Referring to FIG. 2, the body portion 22 and fastener portion 60 include passages 98, 100 respectively, which are in communication with the gap 96 to receive wiring 102 for delivering power to the light housing 16.

Referring to FIG. 3, it will be seen that portions of the second inner surfaces 80 are formed on both of the arms 90 and the lateral portion 94. Furthermore, the pattern of teeth 88 extends in continuous fashion from one arm 90, through the lateral portion 94 to the other arm 90, though other tooth patterns may also be provided which do not necessarily extend along both arms and lateral portion, or in continuous fashion as shown. For that matter, other tooth patterns may be provided on the opposed end regions 76 which do not necessarily extend around the entire periphery thereof, as is discussed below.

The opposed end regions 76 and their corresponding cavities 74 are of sufficiently close dimensions to cause the teeth 86 on each end region 76 to engage the teeth 88 on the arms 90 and lateral portion 94. The arms 90 are resilient to allow the teeth 88 thereon to slide over the teeth 86 on the corresponding end region 76, as shown in FIG. 4*a*. Thus, the arms 90 allow the wall sections 72 to index the position of the body portion 22 through a range of angular positions therebetween, with the rotational increments corresponding to the size of teeth. However, as will be shown, other arrangements may be used without teeth including those described below.

In this example, the play between the wall sections 72 and the opposed end regions 76 is dependent on the relative dimensions therebetween which may include the extent to which the teeth 86 on the opposed end regions 76 match the dimensions of the corresponding teeth 88 on the wall sections 72. It will be understood that the indexing function is dependent on the number of teeth. For example, the opposed end regions 76 may be provided with the teeth 86 as shown herein, but also with one or two teeth 88 or a comparable number of teeth on the arms serving as pawls to provide the indexing. Similarly, it may be suitable to provide one or two teeth or a comparable number of teeth 86 on the opposed end portions with a corresponding array of teeth shown on the wall section 72.

Similarly, the fastener portion 60 is configured to allow limited travel of the light housing 16 in the direction of the second axis 30 to allow the teeth 56 to ride over the teeth 54. Alternatively, the disc member 42 or the light housing 16 in the region of the recessed surface 44, or both, may be sufficiently flexible to allow the interfitting teeth 54 to 56 to slip over one another, to provide a similar indexing function.

The exit sign assembly 10 is assembled as follows. First, exit sign assembly 10 is provided with passages along an upper periphery to form the anchor locations 12. It will, of course, be understood that the passages may be formed on any periphery or suitable surface of the exit assembly. Next, the support assembly is formed with the light housing 16. This involves mating the two symmetrical wall sections 72 with the body portion 22, by inserting the end regions 76 in their corresponding cavities 74, bringing the teeth 86 into engagement with the teeth 88. The wall sections 72 are thus brought together and may be held using a number of anchor flanges and mating anchor recesses, not shown. Other methods may be employed including anchors or separate fasteners being held in corresponding passages and the like. This brings the lower portions of the wall sections together thereby providing the threaded lower section to form the lowermost end 20*a* which is the passed through a corresponding passage at a corresponding anchor location 12 and to be secured therein by a nut or similar fastener, not shown. The rectangular passage of the anchor location 12 and rectangular surface on the boss 72*b* thus cooperate to ensure the post portion 20 does not rotate relative to the passage. If desired, other methods may be employed to secure the lowermost end 20*a* in position including adhesives and the like. If desired the lowermost end 20*a* may also be internally threaded to receive a fastener for anchoring purposes, or otherwise be engaged with other anchoring means for anchoring the lowermost end 20*a* in an operative position.

The disc 42 is installed on the platform 40 by passing the notched webs 62 through the second fastener passage 66 and arranging the projections 68*a* to seat in corresponding recesses 70*a*. The notched webs 62 are then passed through the first fastener passage 64 in the light housing 16. The wiring 102 is then passed through the gap 96 and passages 98 and 100 into the housing 16 to connect with the light source (not shown).

Figure 4:
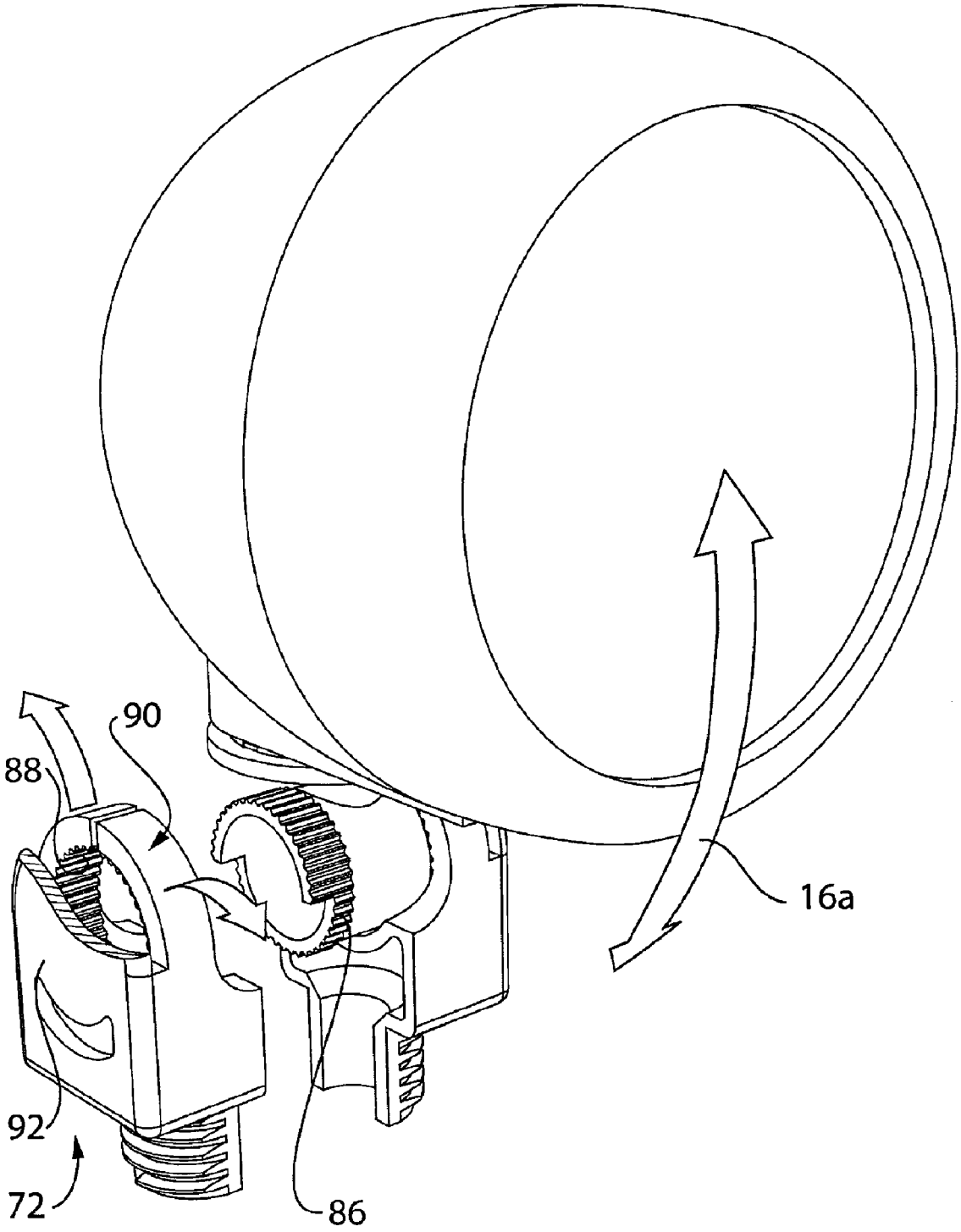
FIG. 4 is a partly fragmented assembly view of a light fixture portion of FIG. 2.
Figure 4A:
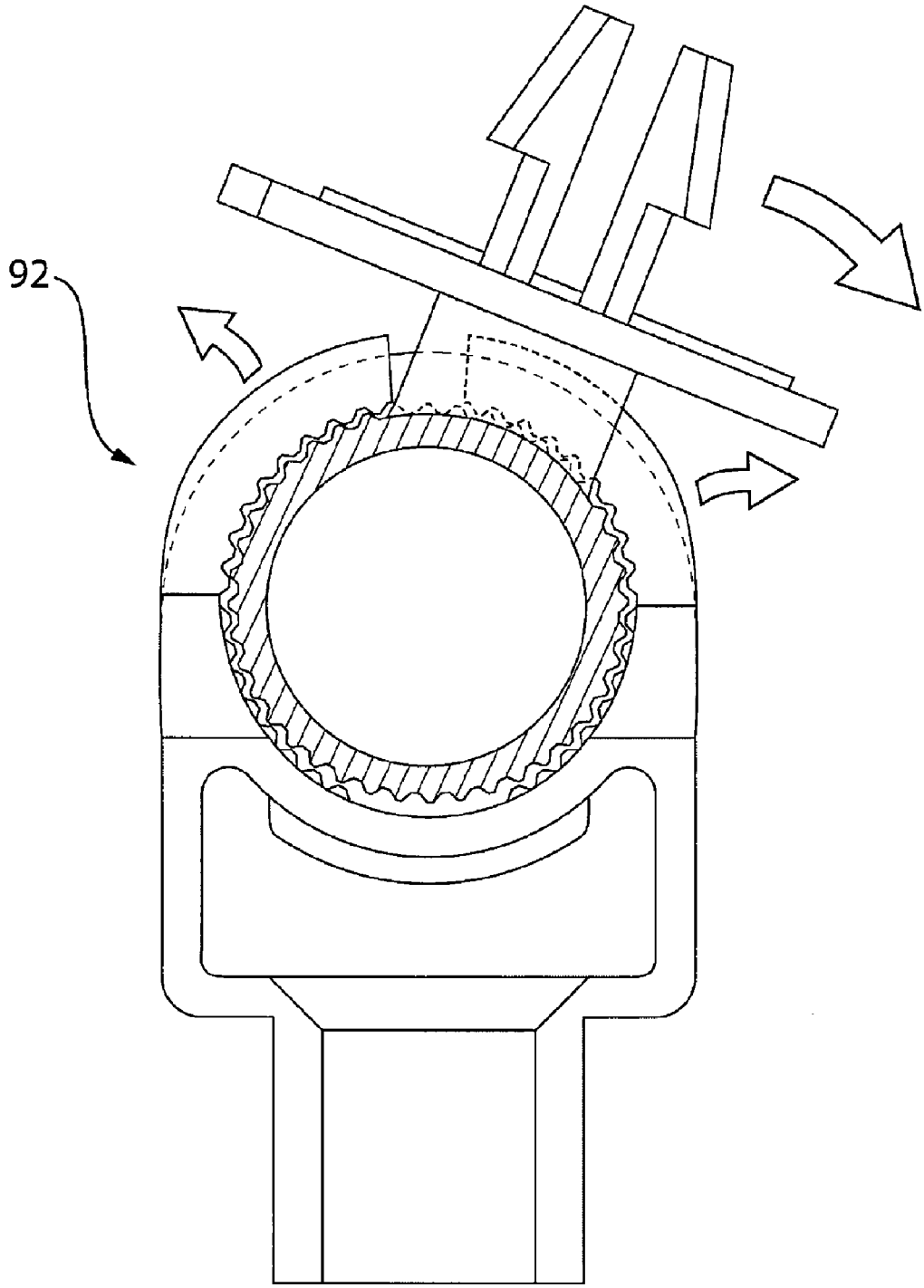
FIG. 4*a* is a sectional view of a segment of the light fixture portion of FIG. 2.
Figure 5:
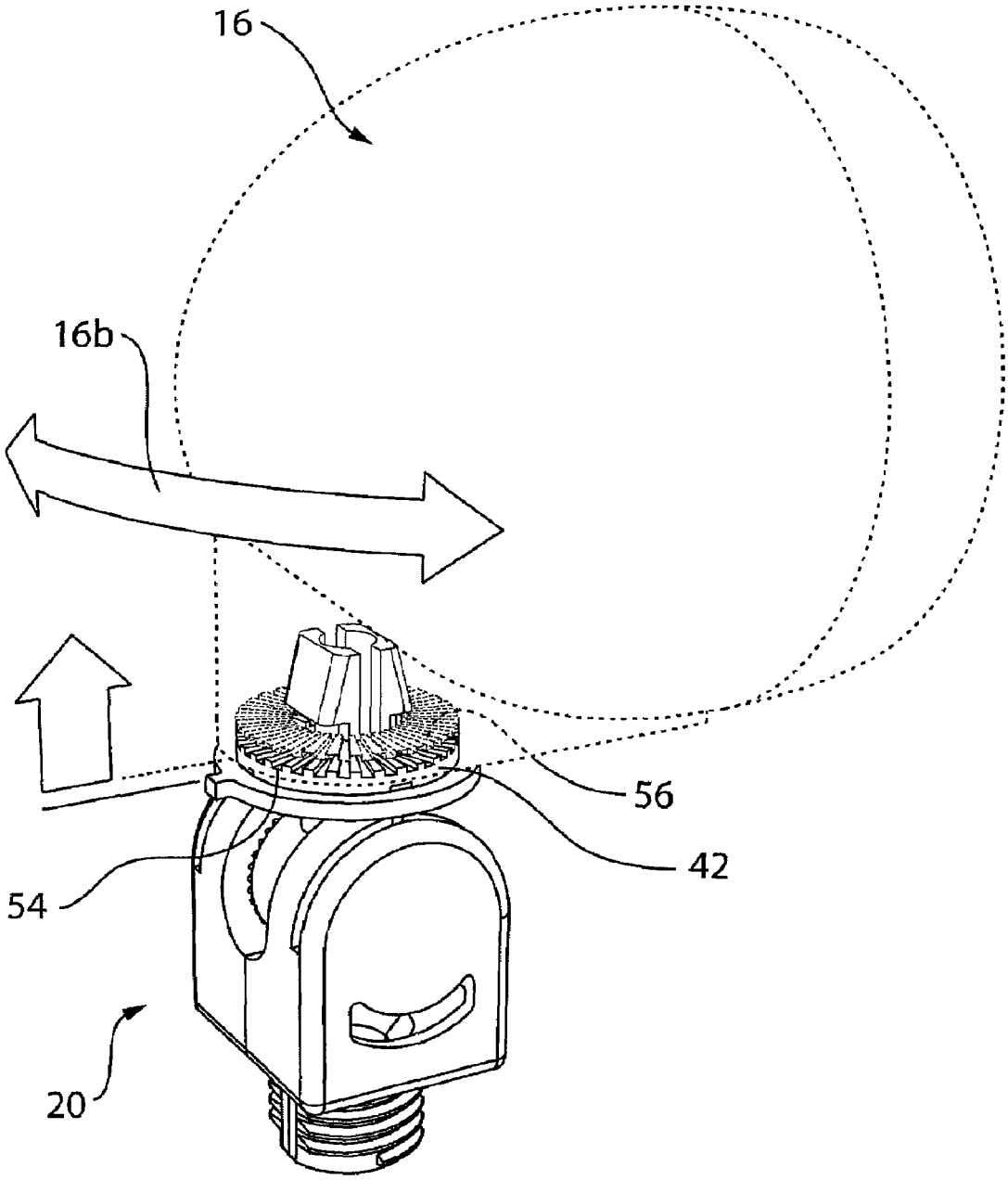
FIG. 5 is a perspective view of the segment portion shown in FIG. 4*a;*
Figure 6:
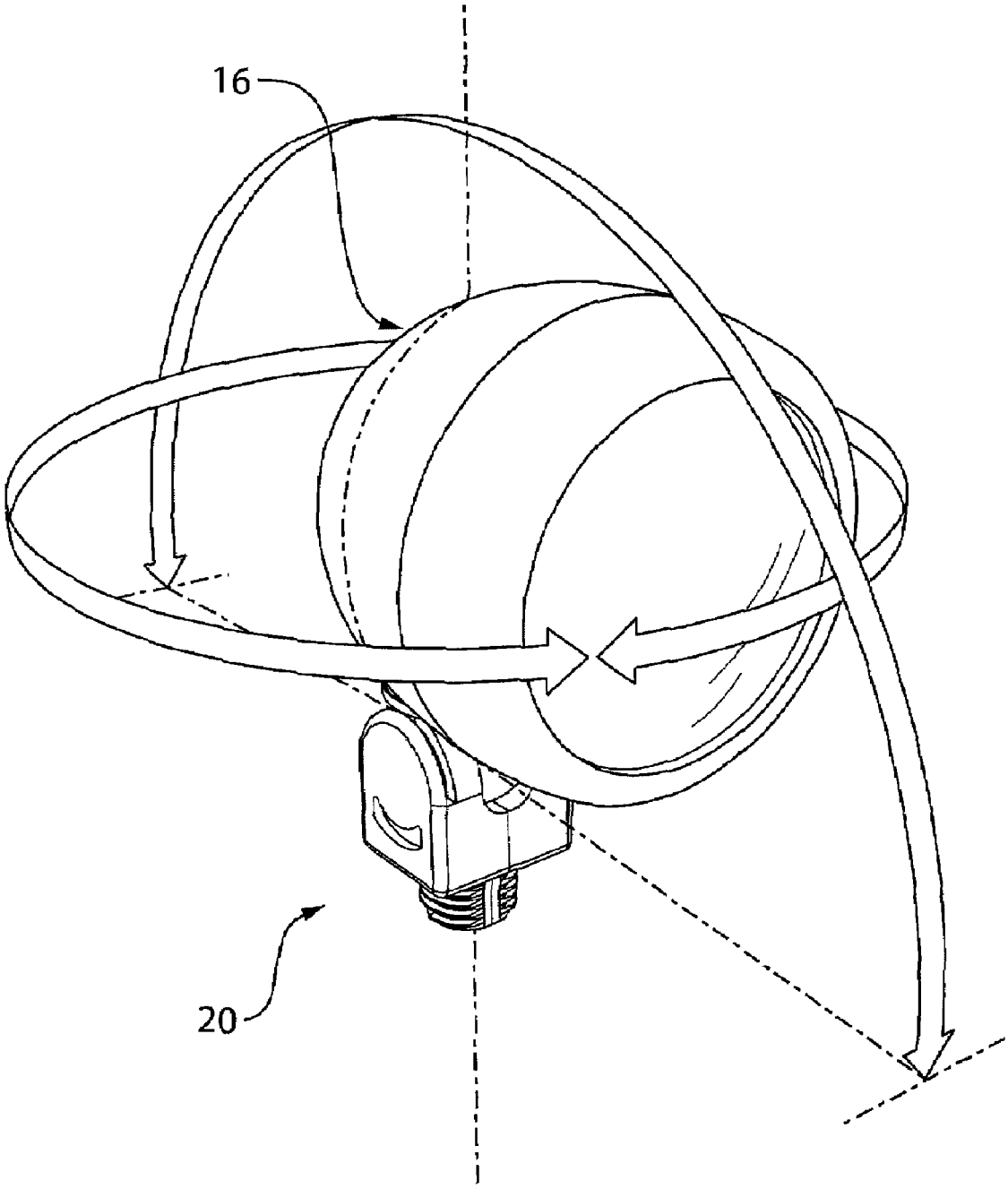
FIG. 6 is an operative perspective view of the light fixture portion of FIG. 2.

Thus, as can be seen in FIG. 4, the interplay between the teeth 86 and 88 allow the housing 16 to be positioned in one of many possible angular positions relative to the support assembly, as shown by arrow 16*a*. Meanwhile, as shown in FIG. 5, the interplay between the teeth 54 and 56 between the housing 16 and the disc member 42 allow the housing 16 to be positioned in one of many possible swivel positions to the support assembly, as shown by arrow 16*b* in FIG. 5.

Figure 7:
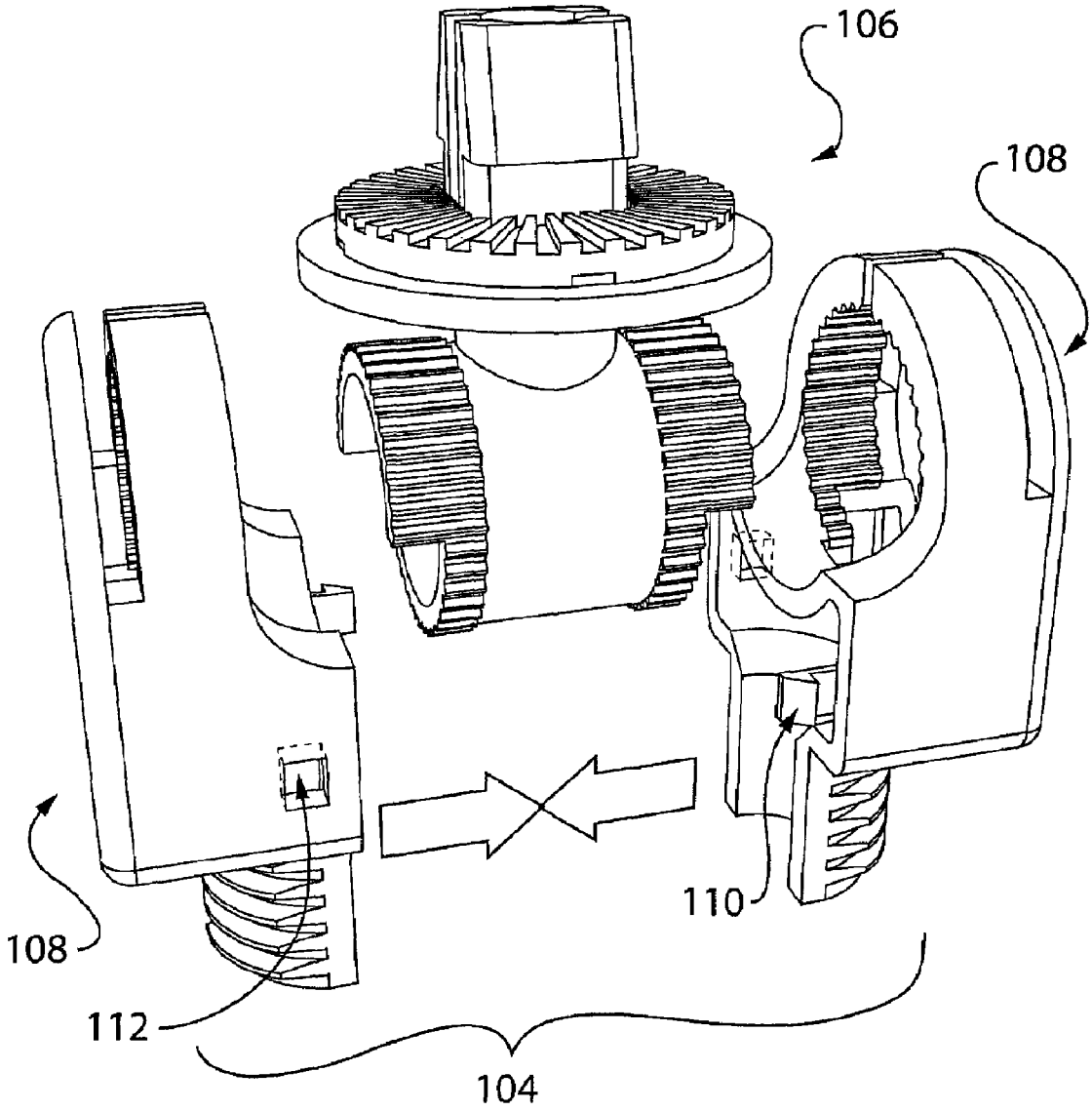
FIGS. 7 to 14 are perspective part assembly views of support assemblies.
Figure 8:
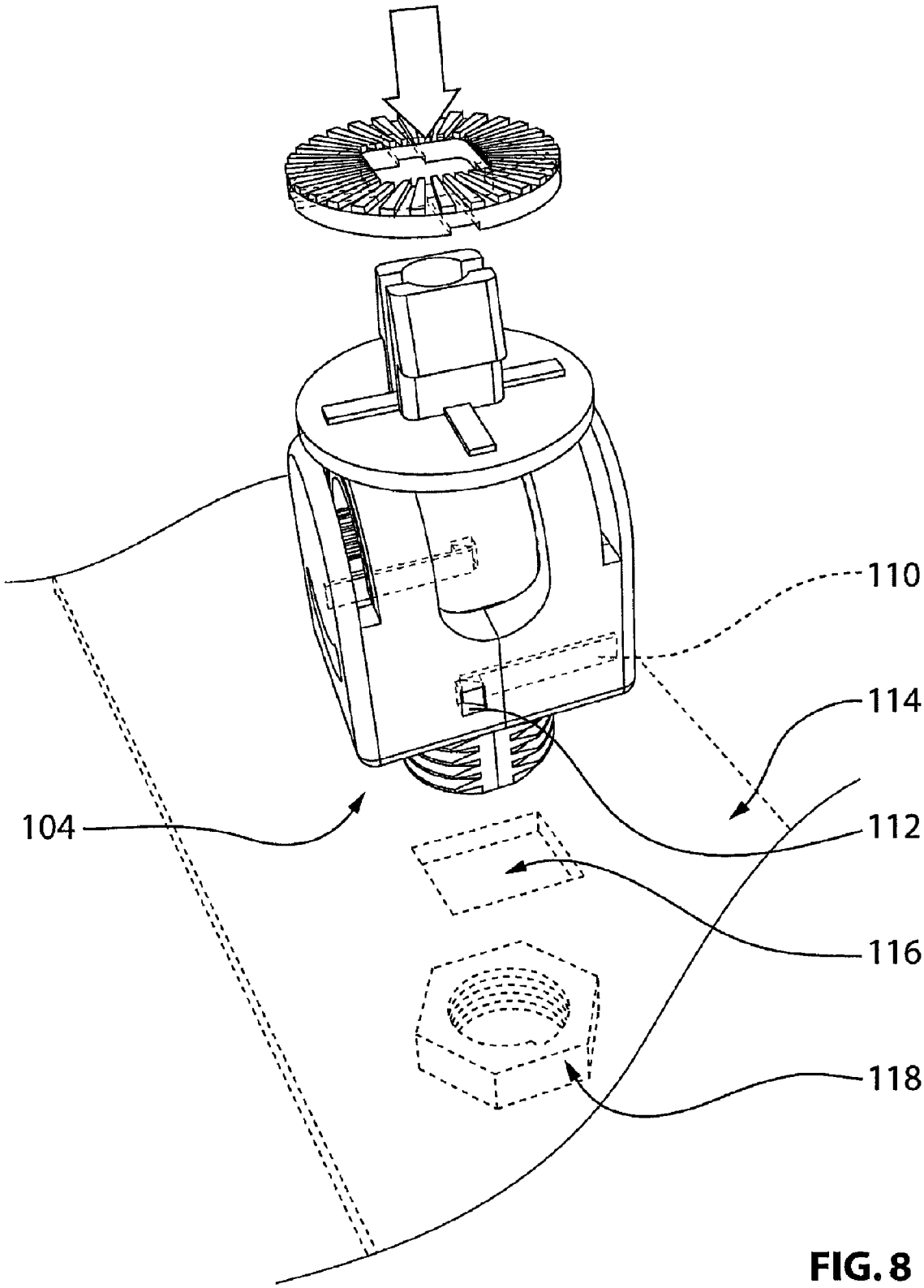

FIGS. 7 and 8 show the post and body portions 104, 106 respectively of another support assembly. In this case, the post portion 104 has end sections 108 which are held together by a number of anchor flanges 110 formed on one end section 108 that mate corresponding anchor recesses 112 on the other end section 108.

Thus, in one example, the exit sign assembly 10 provides a support assembly 18 which may be used as a universal swivel mounting means for supporting a range of light housings and providing two axes of rotation. In one example, the body portion 22 takes the form of a main core component which is enclosed by the two wall sections 72 which take the form of two outer shell components. The core component is hollow providing for passage of the wire horizontally and then through, in this example, a 90 degree turn vertically to a light head or other device requiring aiming, or whose functions may be enhanced by being positioned or supported as described herein. The core component has a cylindrical element that can rotate about its central axis. Attached to this cylindrical element, in this example, at 90 degrees is the platform 40 which provides a seat with anti-rotation registration for the disc member 42 which can be described as a toothed disc gear part. Each end of the cylindrical element of the core component is characterized by gear teeth which cover the full cylindrical circumference, or part thereof, as desired. These teeth mate with matching gear teeth on the inside of each of the housing shell components. Other angular orientations, that are other than 90 degrees, may also be employed, if desired, for the core component and platform.

Once the cylindrical elements of the core component are mated with their respective housing shell components, the housing shell components are held in a closed position via a closure means whether it is by snap fits, adhesive bonding, ultrasonic welding or other means.

In this example, the lower portions of the mated housing shell components form a continuous helical thread. The threaded portion can then be anchored to a substrate, such as that shown in dashed lines at 114 in FIG. 8, such as a wall bracket, a door frame or the like, a battery box or other enclosure, among other examples, through a hole or passage 116 therein and affixed by a nut 118 which may also assist to keep the housing shell components together.

Thus, in one example, the mating internal and external toothed gear surfaces are permitted to rotate one about the other by way of several teeth being affixed to a spring arm (for example as shown at 90 in FIG. 2),formed integrally with the housing shell component 72. When the internal core component 22 is rotated about the light housing, the spring arm is able to deflect outwardly providing relief to the interlocking teeth as the teeth on the core component are forced against the teeth on the housing shell components. As the arm is sprung, the teeth (or tooth) contacts the inner cylinder gear teeth of the core component will act as a pawl, and permits rotation in both directions with the gear teeth acting as positional detents when rotated as they spring back into place with every detent increment rotated.

The housing shell components thus create a wire passageway allowing the one or more than one wire to enter through the center of the threaded portion initially. Openings between the housing shell components and the core component permits the wire to turn and enter the cylindrical element of the core component. The wire then turns to go through the core component and enters the light head or other device when fully assembled. This wire passageway thus allows the wire to pass through the universal swivel mount unimpeded while allowing rotational mobility as provided by the various components. It will of course be understood that power may, if desired, be delivered to the housing 16 by one or more wires which do not necessarily extend through the cylindrical element. For example, the wires, may, if desired, extend along the exterior of the swivel mount.

Thus, the fastener portion 60 may be considered to serve as a neck protruding normal to the central axis of the core component, creating a second axis. Around this second axis and affixed to the neck, the platform 40 supports the disc member 42 with a centrally located hole about the neck. The disc member 42 is inserted over the neck so as to mate with the platform 40. Registration keys form part of the disc member 42 and matching channels form part of the disc member 42, whereby the keys mate with the channels so as to impede rotation of the disc member 42 about the platform 40. Alternatively, the disc member 42 may be integrally formed with the platform 40 as desired.

Thus, once assembled, the core component and two housing shell components and the disc member 42 may be assembled with the light head or other apparatus. This is accomplished, in one example, by notched webs 62 which may be considered to form a fastening or snap fit means found at the top of the neck portion of the core component. The snap fit means may be engaged with a hole found on the light head or other apparatus. Surrounding the hole on the light head is an associated radially oriented gear, formed by the toothed recessed surface 44, which mates with the radial tooth or gear pattern on the disc member 42. The spacing between the gears thus provides a limited interference fit whereby upon exerting a rotational force to the lamp head, the gears have enough relief so as to rotate one over the other, stopping at the specific gear detents and creating resistive forces holding the light head in position at the specific detents. Other arrangements may be provided such as a single gear tooth on the recessed surface, the disc member or both.

Figure 9:
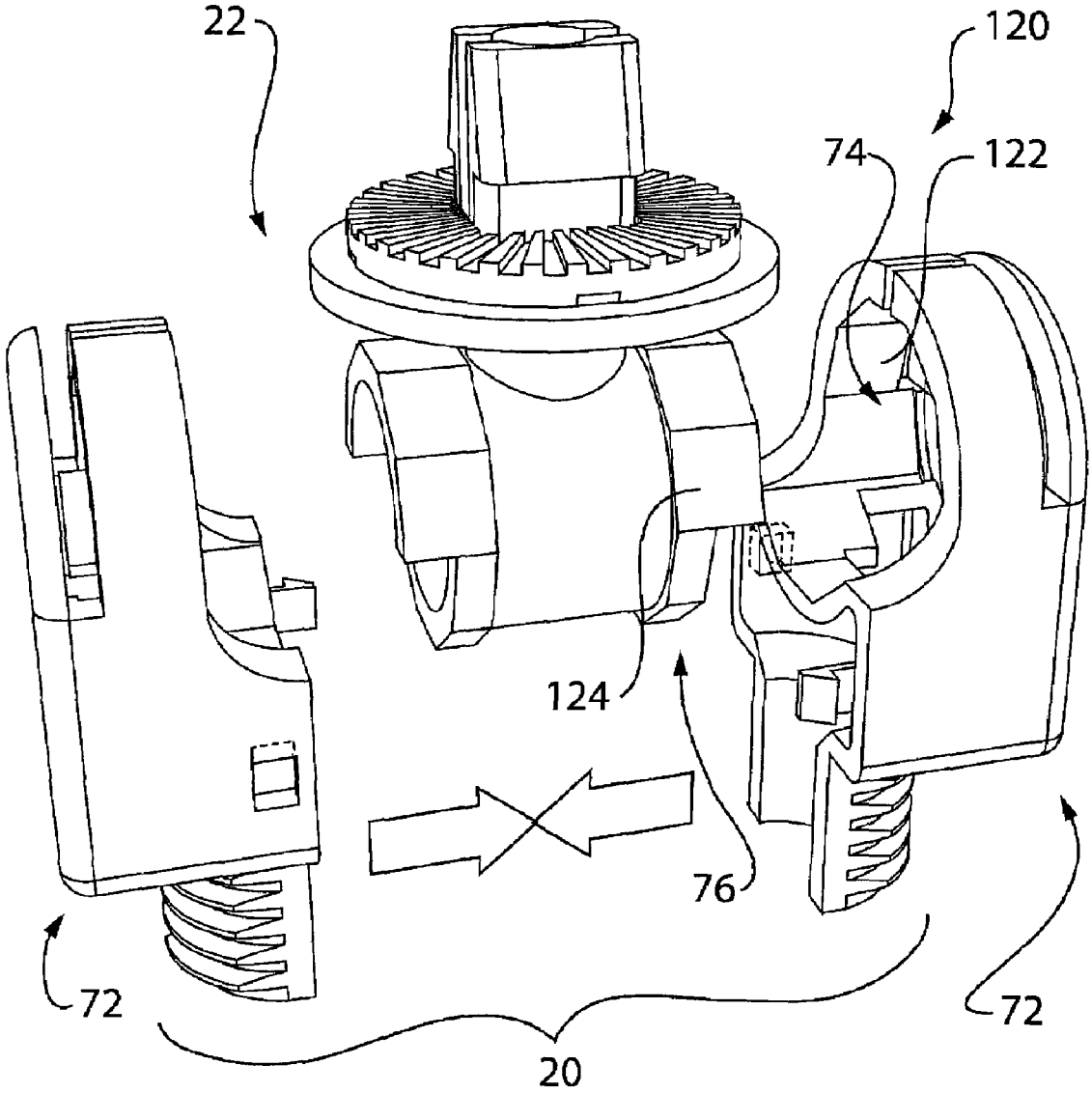

FIG. 9 illustrates a portion of another support assembly 120 having a post portion 20 with opposed wall sections 72, each of which has a cavity 74 to receive a corresponding end region 76 of the body portion 22. In this case, the corresponding cavities and end regions 74, 76 have complementary ten sided cross sections provided by a series of inner and outer indexing surfaces 122, 124 respectively. Of course the number of indexing surfaces may be varied according to the degree of indexing required, provided that the body portion 22 is able to rotate within the post portion 20.

Figure 10:
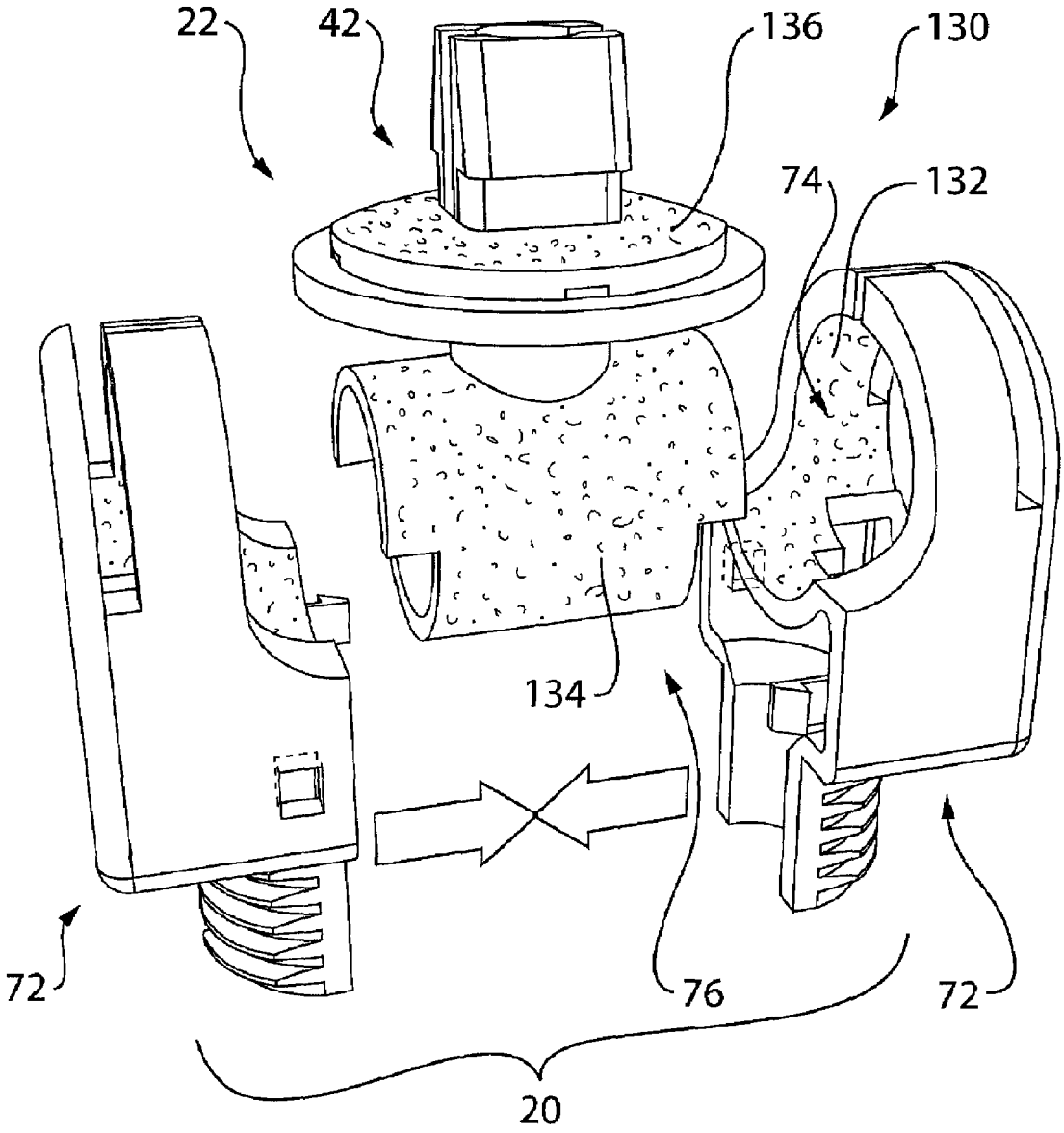

FIG. 10 illustrates a portion of another support assembly 130 having a post portion 20 with opposed wall sections 72, each of which has a cavity 74 to receive a corresponding end region 76. In this case, each corresponding pair of cavities 74 and end regions 76 has a complementary inner and outer surfaces 132, 134 which are formed with a roughed random pattern to match a complementary surface on the light housing, not shown. In this example, the disc member 42 is provided with an upper surface 136 similarly provided with the roughed surface random pattern. The pattern may, of course, not be random but can be a repeating pattern. In this case, the pattern is selected together with the relative dimensions of the opposed wall sections 72 and end regions 76 to provide sufficient resistance to hold the body portion 22 in position, thereby to support the light fixture or other apparatus in any one of a number of operable positions through the range of movement of the body portion 22 relative to the post portion 20.

Figure 11:
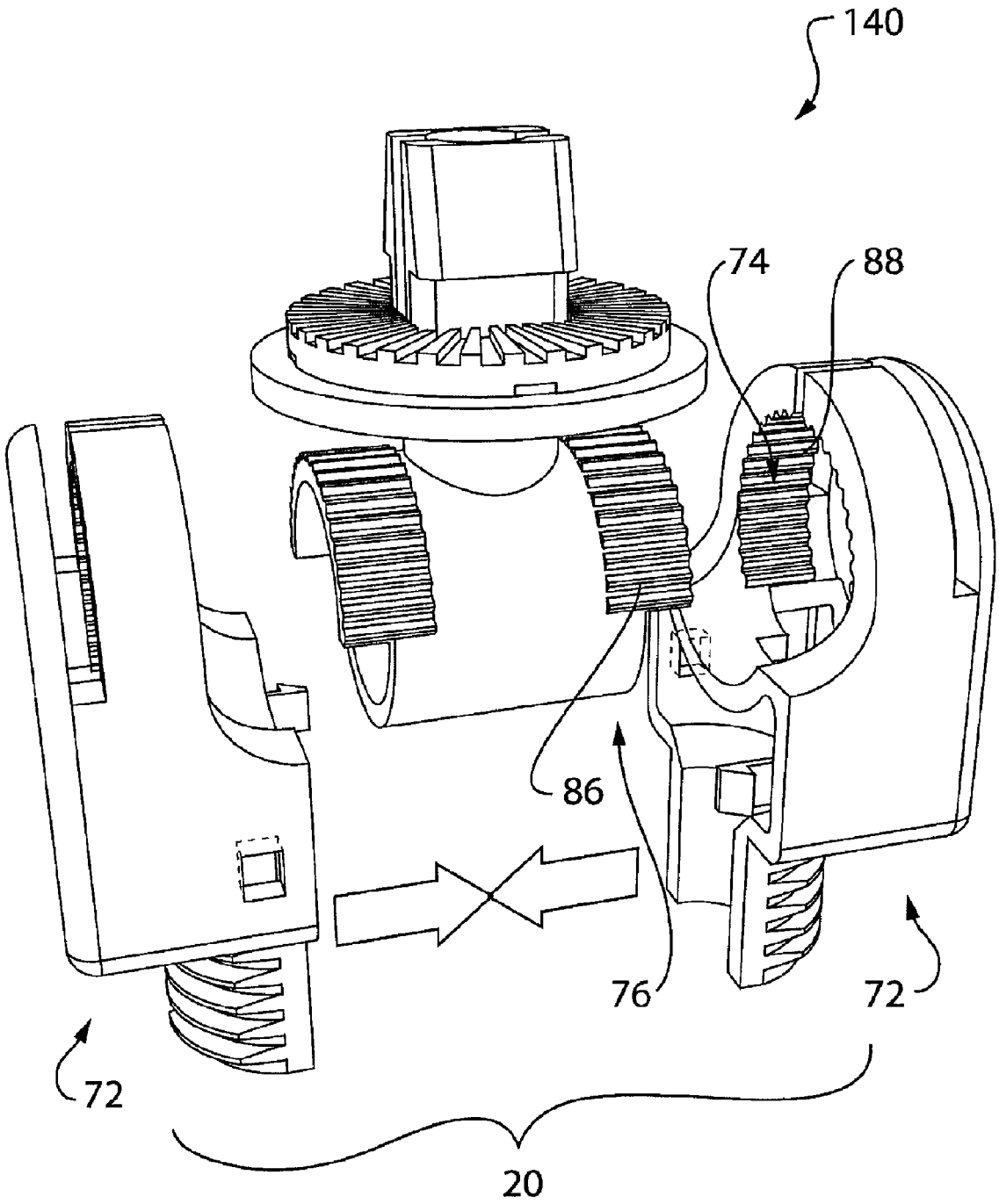
Figure 12:
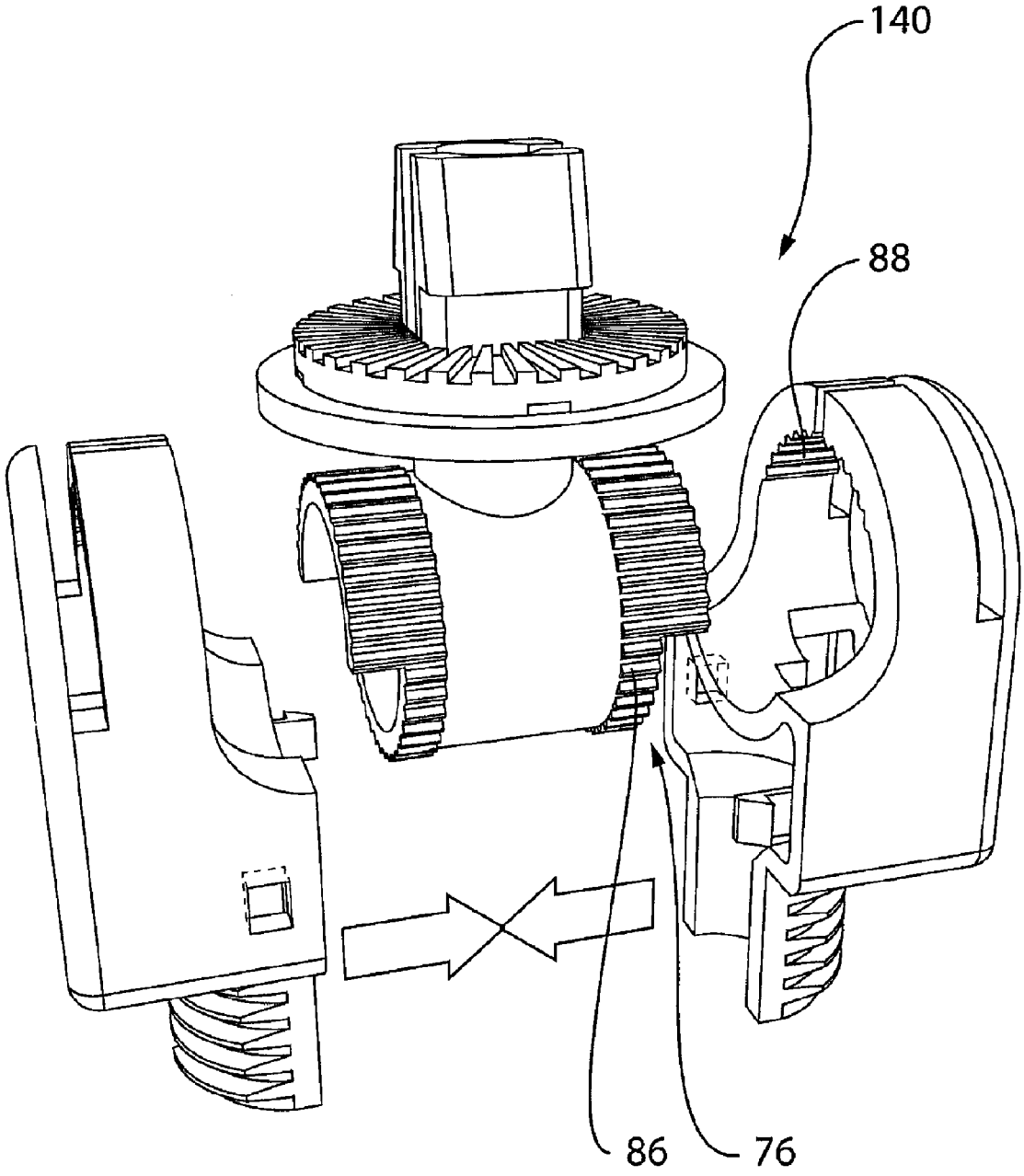
Figure 13:
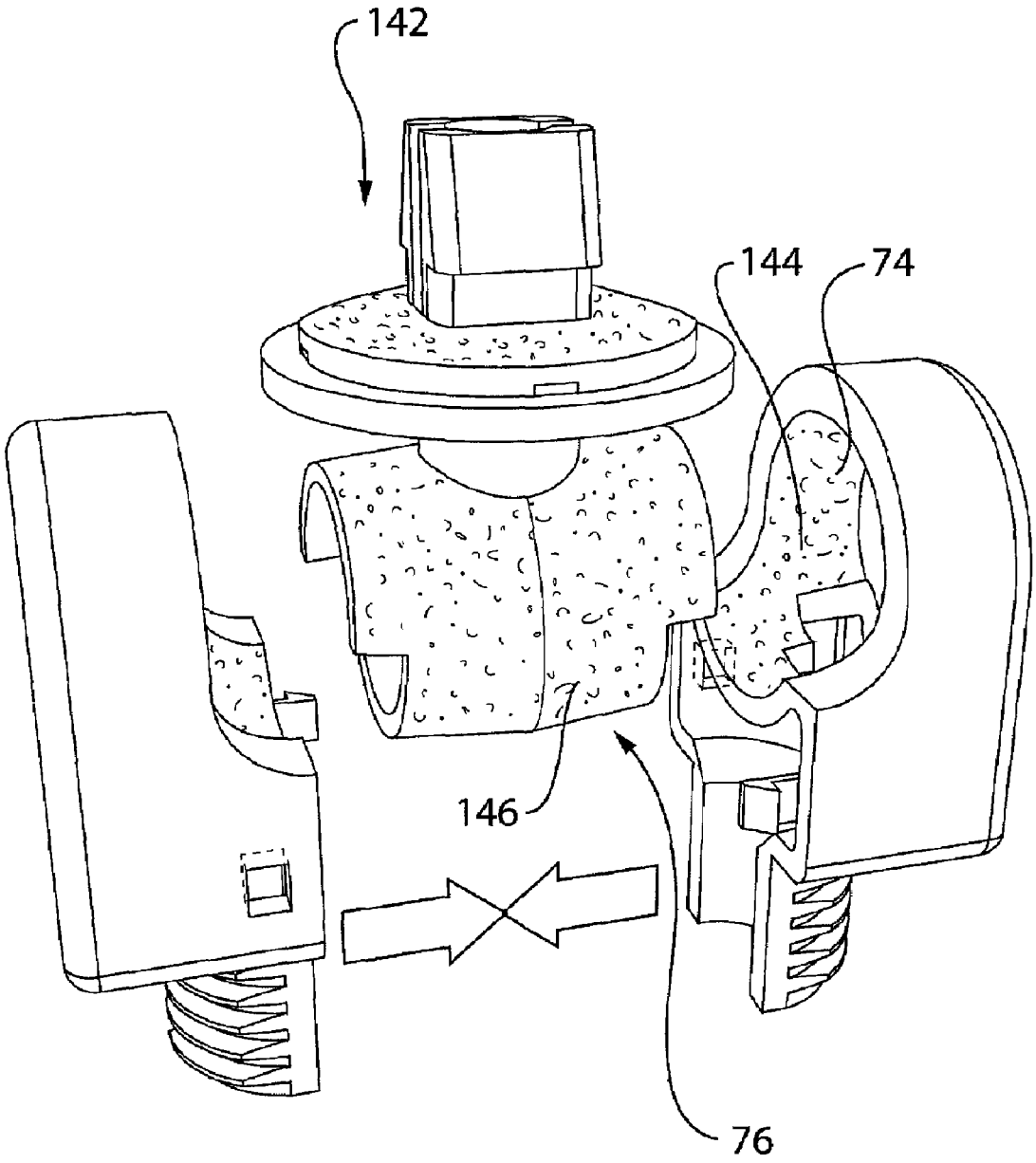

FIG. 11 illustrates a portion of yet another support assembly 140 having a post portion 20 with opposed wall sections 72, each of which has a cavity 74 to receive a corresponding end region 76. In this case, each corresponding pair of cavities 74 and end regions 76 has a pattern of teeth 88, 86, though the teeth 86 on the end regions 76 covers only the upper region thereof as shown in FIG. 11. In the version shown in FIG. 12, the teeth 88 in the cavities 74 terminates to within a region of roughly 10 o'clock and 2 o'clock when viewed in front plan and the teeth 86 extend the full periphery of the end region 76. FIG. 13 illustrates a portion of another support assembly 142. In this case, the cavities 74 and end regions 76 have complementary inner and outer surfaces 144, 146 which are formed with a roughed random pattern as discussed above (with the applicable alternatives described above), but also tapered slightly to enhance further the frictional interaction between the body portion and post portion.

Figure 14:
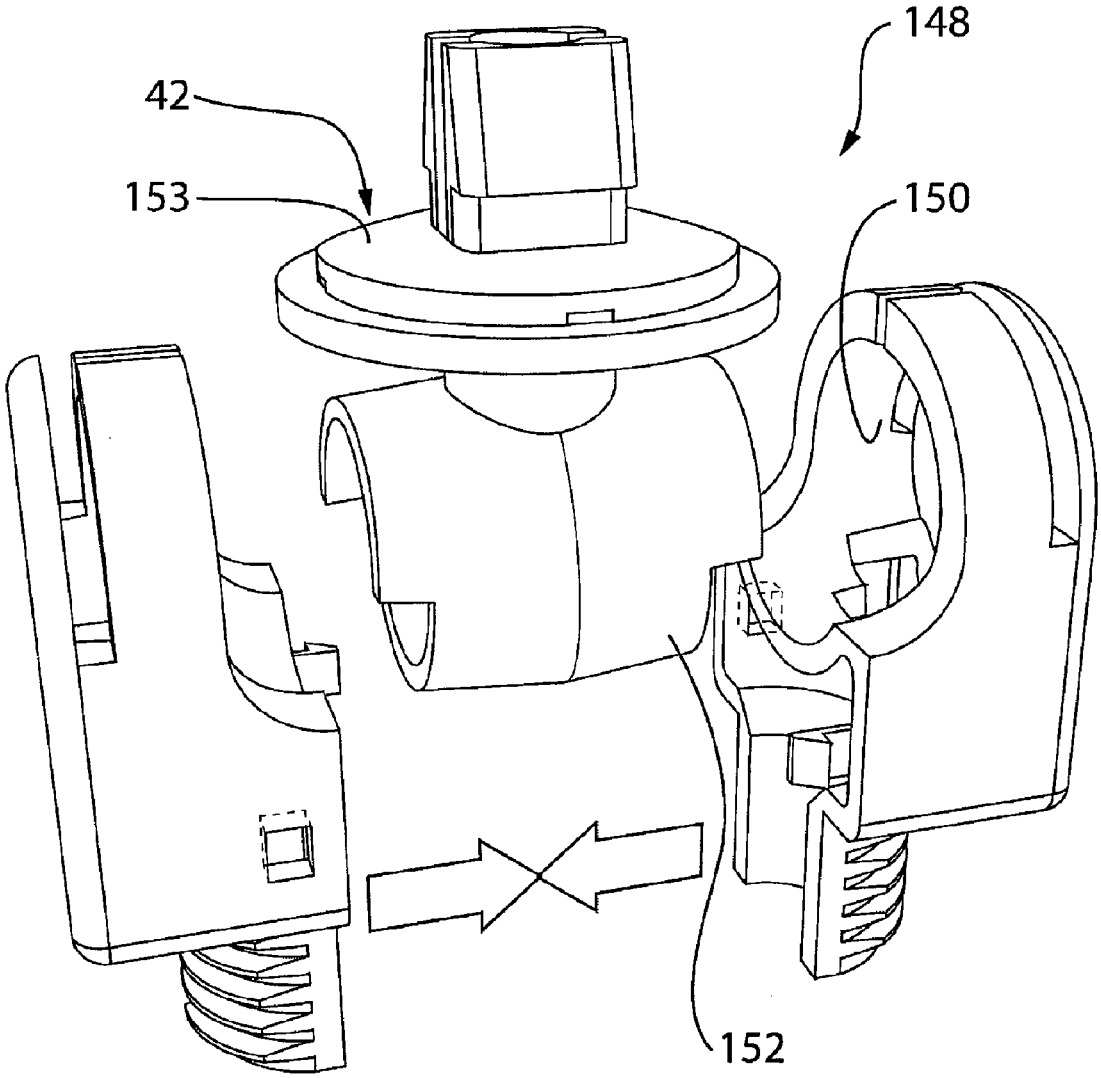
Figure 15:
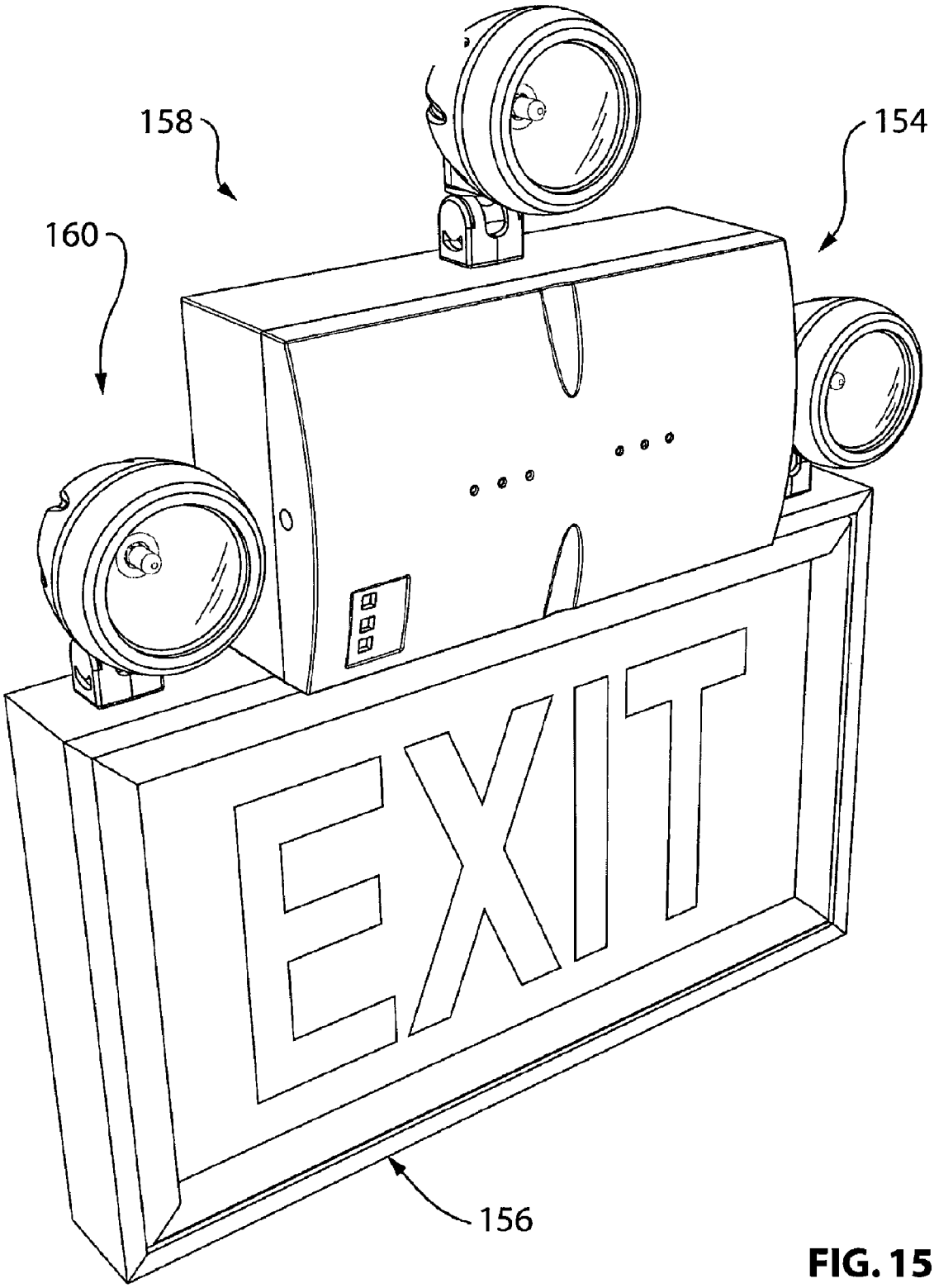
FIG. 15 is a perspective assembly view of another exit sign assembly.

FIG. 14 illustrates a portion of another support assembly 148. In this case, the inner and outer surfaces 150, 152 are relatively smooth and tapered slightly to enhance further the frictional interaction between the body portion and post portion. In this case, the disc member 42 has a smooth surface 153 to engage a complementary surface on the housing (not shown). In this case, the dimensions of the disc member 42 and the recessed surface on the housing (and indeed the dimensions of the components bearing the inner and outer surfaces 150, 102) may be selected with suitable dimensions to rely on a frictional engagement between the adjacent surfaces in which one or both of the surfaces is relatively smooth. In this case, the disc 42 or an associated structure of the housing may be formed of resilient polymeric materials which have a relatively higher coefficient of friction among the various polymer materials available. For instance, the examples herein may be formed from a range of polymeric materials including polyvinyl chlorides, polystyrenes, polyethylenes, polypropylenes, while for those components bearing a relatively smooth surface such as the surfaces 150, 152 and 153 be formed from polyurethanes, polymeric rubbers and the like, or layers thereof on other polymeric materials. FIG. 15 shows another exit sign assembly 154 comprising an exit sign housing 156, a battery housing 158 and a plurality of light fixtures 160, as described herein. Similarly, in some cases, the housing portion 16 may be swiveled to the body portion as above described while the body portion if itself fixed to an anchor surface with no corresponding swivel capability relative thereto.

If desired, the disc and platform may be integrally formed. Furthermore, though having less adjustability than in the earlier examples, the housing 16 may be fixed to the body portion, while the latter is held by the post portion in the manner described hereinabove.

While the support assemblies herein disclose the use of a pair of outer cylindrical surfaces formed on outer cylindrical end portions of a body portion to engage surfaces in neighboring cavities of the opposed end sections, the cylindrical surfaces may instead be formed on inner region of the body portion to engage exterior surfaces formed on the cavities or equivalent structure on the opposed end sections. In this case, the surfaces are reversed and may provide suitable results. In this case, the inner and outer surfaces may be provided with locking formations of the varying types described herein.

While the present invention has been described for what are presently considered the preferred embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A light fixture device comprising a light housing to receive a light source therein, a support assembly for supporting the light fixture relative to an anchor location, the support assembly including a post portion for mounting at the anchor location and a body portion, the body portion having a pair of opposed end regions, the post portion including a pair of cavities, each to receive a corresponding end region, the body portion being movable relative to the post portion about a first axis, the body portion and light housing having respective first and second support formations, the light housing being movable relative to the body portion about a second axis, to cause corresponding relative movement between the first and second support formations, the end regions and cavities having complementary third and fourth support formations, wherein relative movement between the body portion and post portion causes a corresponding relative movement between the complementary third and fourth formations, the first and second support formations being operable for releasably locking the position of the light housing relative to the support assembly, the first and second support formations include complementary locking elements, the locking elements including projections, the projections include one or more teeth, each of the first and second support formations including at least one support surface with the teeth distributed along the support surface, the body portion including a platform and a disc member positioned on the platform, the light housing further comprising a recessed surface which is complementary with the disc member, a fastener portion for fastening the light housing to the body portion, the light housing further comprising a first fastener passage centrally disposed in the recessed surface to receive the fastener portion, the disc member including a second fastener passage, the fastener portion being integrally formed with the platform to extend through the second fastener passage.

2. A device as defined in claim 1, wherein the fastener portion includes a pair of resilient notched webs, each to engage a peripheral portion of the light housing adjacent the first fastener passage.

3. A device as defined in claim 2, wherein the platform and disc member have complementary engaging formations thereon to inhibit relative movement therebetween.

4. A device as defined in claim 3, wherein the complementary formations include a plurality of projections on the platform which engage corresponding recesses in the disc member.

5. A light fixture device, comprising a post portion having a pair of opposed end sections, a body portion having a first axis and a pair of opposed cylindrical end regions disposed in line with the first axis, each cylindrical end region arranged to engage a corresponding end section, a mounting fastener extending from the elongate body portion and beyond the end sections, the mounting fastener supporting a light fixture, each cylindrical end region having an outer cylindrical surface, each end section having an inner cylindrical surface to receive a corresponding outer cylindrical surface, each end section including at least one spring arm bordering the inner cylindrical surface, the at least one spring arm biased toward and engaging the corresponding outer cylindrical surface in a manner sufficient to releasably maintain the elongate body portion in an operative position; wherein each side wall section includes an opposed pair of the spring arms, at least a portion of the second inner surface being formed on each of the arms.

6. A device as defined in claim 5, wherein each side wall section includes an end panel adjacent each arm.

7. A device as defined in claim 6, wherein each side wall section includes a lateral portion adjacent the arms.

8. A device as defined in claim 7, wherein the lateral portion is spaced from the end panel to form a gap therebetween.

9. A device as defined in claim 8, wherein the body portion and fastener portion include passages in communication with the gap to receive wiring for delivering power to the light housing.

10. A device as defined in claim 5 wherein the first outer surfaces and the second inner surfaces include complementary locking elements.

11. A device as defined in claim 10, wherein the locking elements include projections.

12. A device as defined in claim 11, wherein the projections include one or more teeth.

13. A method of supporting an article, comprising the steps of:

providing an anchor portion with a pair of opposed cylindrical shell elements;

providing an elongate body portion with a first axis and a pair of opposed cylindrical end regions cylindrically disposed in line with the first axis, providing each cylindrical end region on the elongate body portion with an outer cylindrical surface and providing each cylindrical shell element with an inner cylindrical surface, fitting each cylindrical end region within a corresponding shell element by engaging each outer cylindrical surface with a corresponding inner cylindrical surface, joining a mounting portion to the elongate body portion to extend beyond the cylindrical shell elements for mounting an article thereon, and providing at least one arm on each cylindrical shell element in a position to border the corresponding inner cylindrical surface to be biased toward and to engage the corresponding outer cylindrical surface in a manner to provide sufficiently firm engagement between the cylindrical end regions and the corresponding cylindrical shell elements for releasably holding the elongate body portion in an operative position.

14. A light fixture device, comprising a support post having a pair of opposed hubs, a lamp support body having a first axis and a pair of opposed cylindrical rotation ends disposed in line with a first axis, each cylindrical rotation end arranged to engage a corresponding hub in said support post, a mounting fastener extending from said lamp support body and above said hubs, said mounting fastener supporting a light fixture, each cylindrical rotation end having an outer cylindrical surface, each hub having an inner cylindrical surface to receive said outer cylindrical surface of said rotation end, each hub including at least one spring arm bordering said inner cylindrical surface, the at least one spring arm biased toward and engaging the corresponding outer cylindrical surface in a manner sufficient to releasably maintain said light fixture in an operative position.

15. A device as defined in clam 14, the mounting fastener including a first passage, the lamp support body including a second passage, at least one of said hubs including a third passage, the first, second and third passages being in communication with one another to form a channel to receive electrical wiring to extend between said light fixture and a remote power source beyond the support post.

16. A device as defined in claim 14, wherein the outer and inner cylindrical surfaces include complementary releasable locking formations for indexing relative movement therebetween.

17. A device as defined in claim 16, the at least one spring arm including one or more of the releasable locking formations.

18. A device as defined in claim 16, the indexing formations including a series of inner and outer indexing surfaces on the hubs and rotation ends respectively, the number of indexing surfaces being selected according to a desired degree of indexing.

19. A device as defined in claim 16, the indexing formations including a roughened random pattern on each of the outer and inner cylindrical surfaces.

20. A device as defined in claim 14, the inner and outer cylindrical surfaces being tapered.

21. A light fixture device for supporting a lamp, comprising:

a support post retained within an emergency light housing which supports a lamp, said support post having a pair of opposed hubs, each of said hubs formed by a spring arm and having an interior indexing surface;

a lamp support body having a pair of opposed cylindrical rotational ends disposed in said pair of opposed hubs of said support post, each cylindrical rotational ends having an exterior indexing surface and arranged to engage said indexing surface of said hub, a mounting fastener extending upwardly from said lamp support body and above said opposed cylindrical rotational ends, said mounting fastener having an upper rotational indexing surface engageable against a lower indexing surface of the lamp;

wherein each of said spring arm of said hub provides engageably releasable indexing contact with said respective rotational end of said lamp support body allowing said lamp to be indexably rotated into a plurality of positions about a first axis;

and further wherein said mounting fastener's upper rotational indexing surface allows said lamp to be indexably rotated into a plurality of positions about a second axis substantially perpendicular to said first axis.

* * * * *